US007288713B2

(12) United States Patent
Krozack et al.

(10) Patent No.: US 7,288,713 B2
(45) Date of Patent: Oct. 30, 2007

(54) BOBBIN AND PICKUP FOR STRINGED MUSICAL INSTRUMENTS

(75) Inventors: Edwin Krozack, Chester, MD (US); Paul Reed Smith, Lothian, MD (US)

(73) Assignee: Paul Reed Smith Guitars, Limited Partnership, Stevensonville, MD (US)

( * ) Notice: Subject to any disclaimer, the term of this patent is extended or adjusted under 35 U.S.C. 154(b) by 465 days.

(21) Appl. No.: 11/029,420

(22) Filed: Jan. 6, 2005

(65) Prior Publication Data

US 2005/0150365 A1 Jul. 14, 2005

Related U.S. Application Data

(60) Provisional application No. 60/536,249, filed on Jan. 14, 2004.

(51) Int. Cl.
*G10H 3/18* (2006.01)

(52) U.S. Cl. ..... 84/726

(58) Field of Classification Search ..... 84/726–728
See application file for complete search history.

(56) References Cited

U.S. PATENT DOCUMENTS

| | | | | |
|---|---|---|---|---|
| 2,119,584 | A | 6/1938 | Knoblaugh | |
| 2,896,491 | A | 7/1959 | Lover | |
| D188,348 | S | 7/1960 | Berglund | |
| 3,588,311 | A | 6/1971 | Zoller | |
| 3,657,461 | A | 4/1972 | Freeman | |
| 3,711,619 | A | 1/1973 | Jones et al. | |
| 3,902,394 | A | 9/1975 | Stich | |
| 3,916,751 | A | 11/1975 | Stich | |
| 4,372,186 | A | 2/1983 | Aaroe | |
| 4,442,749 | A | 4/1984 | DiMarzio et al. | |
| 4,501,185 | A | 2/1985 | Blucher | |
| 4,524,667 | A | 6/1985 | Duncan | |
| D283,899 | S | 5/1986 | Peavey | |
| D287,602 | S | 1/1987 | Smith et al. | |
| 4,809,578 | A | 3/1989 | Lace | |
| 5,111,728 | A | 5/1992 | Blucher | |
| 5,168,117 | A | 12/1992 | Anderson | |
| 5,354,949 | A | 10/1994 | Zwaan | |
| 5,525,750 | A | 6/1996 | Beller | |
| 5,530,199 | A * | 6/1996 | Blucher | 84/728 |
| D381,355 | S | 7/1997 | Frank-Braun | |
| 5,668,520 | A | 9/1997 | Kinman | |
| 5,789,691 | A | 8/1998 | Stich | |
| 5,811,710 | A | 9/1998 | Blucher et al. | |
| 5,854,437 | A | 12/1998 | Merrick et al. | |
| 6,316,713 | B1 | 11/2001 | Furst et al. | |
| 6,525,258 | B1 * | 2/2003 | Powers | 84/728 |
| 6,613,968 | B1 | 9/2003 | Devereaux et al. | |
| 6,849,792 | B2 | 2/2005 | Yeakel | |
| 6,911,590 | B2 | 6/2005 | Childress | |
| 7,227,076 | B2 * | 6/2007 | Stich | 84/726 |
| 2002/0020281 | A1 | 2/2002 | Devers | |

* cited by examiner

*Primary Examiner*—Jeffrey W Donels
(74) *Attorney, Agent, or Firm*—Barnes & Thornburg LLP

(57) ABSTRACT

A bobbin for a pickup including a base and a top or cover spaced and connected by a post structure integral thereto. The post structure has one or more cavities for receiving one or more pole pieces. The post structure includes a plurality of lateral windows so that the one or more pole pieces in the one or more cavities would be immediately adjacent windings of one or more coils to be wound on the bobbin.

40 Claims, 2 Drawing Sheets

BOBBIN AND PICKUP FOR STRINGED MUSICAL INSTRUMENTS

CROSS-REFERENCE

This application claims the benefit of U.S. Provisional Patent Application Ser. No. 60/536,249 filed on Jan. 14, 2004, which is incorporated herein by reference.

BACKGROUND AND SUMMARY OF THE DISCLOSURE

The present disclosure is directed to an electromagnetic pickup for stringed musical instruments and, more specifically, to an improved bobbin and pickup for stringed musical instruments.

The electrification of stringed musical instruments includes pickups to pick up the vibration of the strings and convert them into electrical signals. There are two main classes of pickups. One is electromagnetic pickups, which sense vibration of the string in a magnetic field. The other class is piezoelectric pickups, which contact the string and senses its movement. Many kinds of electromagnetic pickups have been designed for stringed instruments. These include single coils and dual hum canceling coils. The dual hum canceling coil is designed and wired to cancel the electric noises and interference picked up by the coils. The two coils have opposite magnetic and electrical polarities. The noise, which is electrically induced in the coils, cancel each other out. The bobbins and pickups are generally designed specifically for a single coil or dual hum canceling coils.

The present disclosure is a bobbin for a pickup including a base and a top or cover spaced and connected by a post structure integral thereto. The post structure has one or more cavities for receiving one or more pole pieces. The post structure includes a plurality of lateral windows so that the one or more pole pieces in the one or more cavities would be immediately adjacent windings of one or more coils to be wound on the bobbin.

The present disclosure also includes a bobbin and a pickup using the bobbin capable of being used for a single coil pickup or a dual hum canceling coil pickup. The bobbin for a pickup includes a base and a top or cover spaced and connected by a post structure. The post structure has one or more cavities for receiving one or more pole pieces. At least two recesses are provided on a first lateral edge of the base, and a terminal is in the base for each recess. A third recess is provided on a lateral edge of the base opposite the first lateral edge and extending substantially a length of the one or more cavities. The third recess is provided for receiving a magnet for the one or more pole pieces. Alternatively, the magnet may be in the one or more cavities.

In a further embodiment, the bobbin for a pickup includes a base and a top or cover spaced and connected by a post structure. The post structure has one or more cavities for receiving one or more pole pieces. At least two recesses are provided on a first lateral edge of the base, and a terminal is in the base for each recess. Each terminal has a first portion extending into the recess and a second portion extending from a first outer surface of the base transverse to the first portion.

A pickup for a stringed musical instrument of the disclosure includes a bobbin having a base and a top or cover spaced and connected by a post structure, at least one pole piece in at least one cavity in the post structure, and at least two terminals in the base and having a first portion extending from a face of the base. A coil having a wire is wound around the post structure and has ends connected to respective terminals. A magnet is provided in the bobbin adjacent the at least one pole piece. A printed circuit board is secured to the base by the terminals and having an electrical connector electrically connected to the terminals.

A dual pickup for a pickup for a stringed musical instrument of the disclosure includes two bobbins each having a base and a top or cover spaced and connected by a post structure, at least one pole piece in at least one cavity in the post structure, at least two terminals in the base and having a first portion extending from a first face of the base, a coil having a wire wound around the post structure and having ends connected to respective terminals, and a magnet in the bobbin adjacent the at least one pole piece. A printed circuit board is secured to the bases by the terminals and has an electrical connector electrically connected to the terminals. A common magnet bridges the adjacent bases.

These and other aspects of the present disclosure will become apparent from the following detailed description of the disclosure, when considered in conjunction with accompanying drawings.

DETAILED DESCRIPTION OF THE PREFERRED EMBODIMENTS

Figure 1:
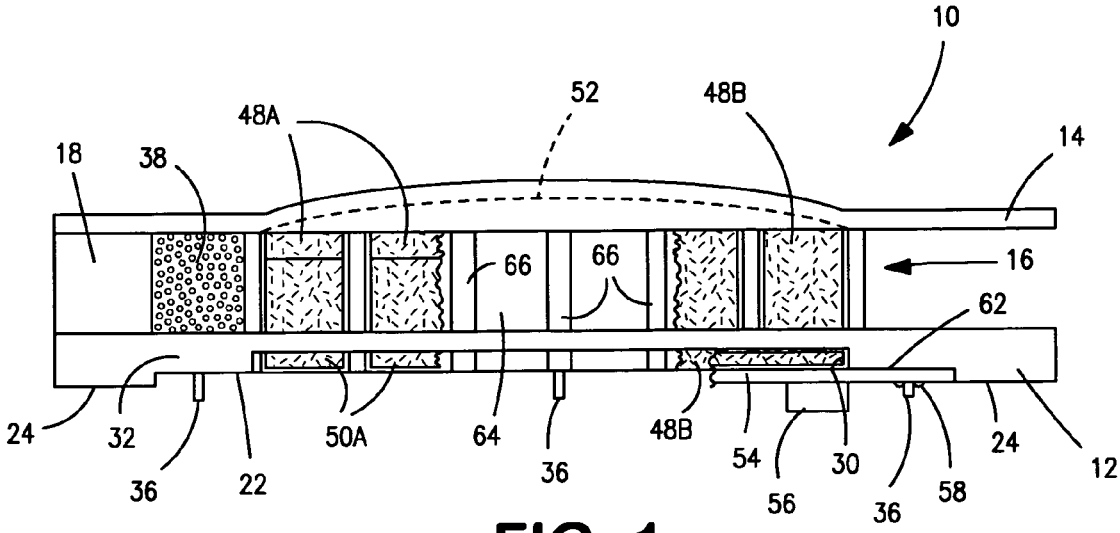
FIG. 1 is a side view of a bobbin pickup with portions cut away according to the present disclosure.
Figure 2:
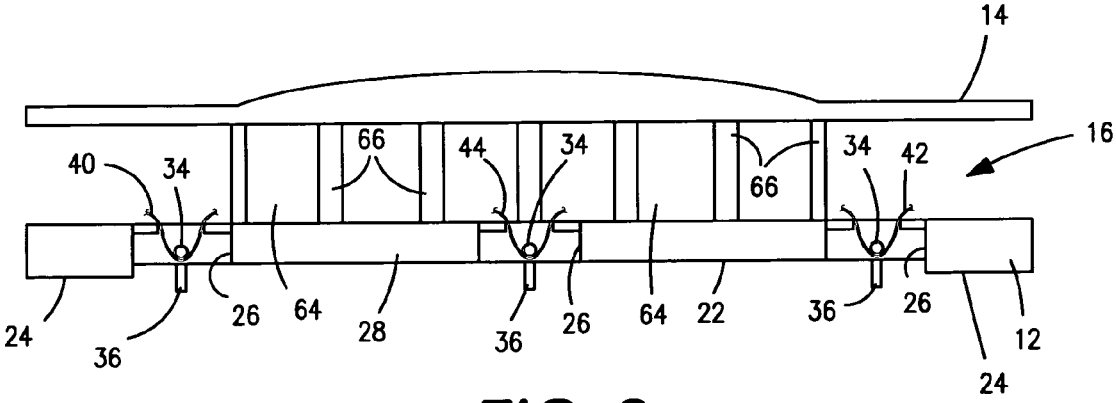
FIG. 2 is the opposite side view of the bobbin without pole pieces, magnets or a printed circuit board.
Figure 3:
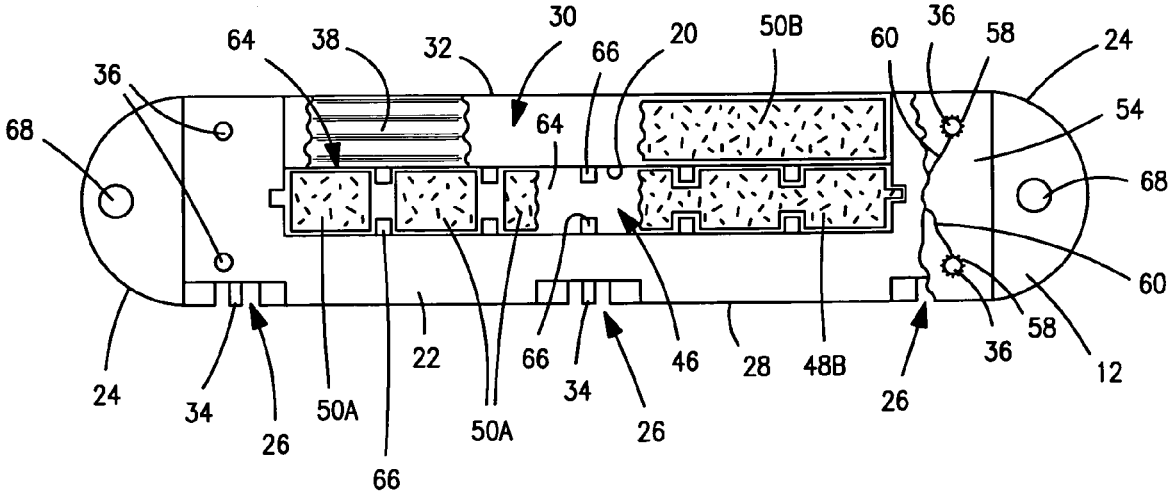
FIG. 3 is a bottom view of the pickup of FIG. 1.

The bobbin of the present disclosure has the capability to be used for a single coil pickup, or it may be used in pairs for a dual coil hum canceling pickup. Also, the bobbin is designed for increased magnetic efficiency. For sake of clarity and examples, FIGS. 1 and 3 show the bobbin with wires and printed circuit board included, as well as two different kinds of pole pieces and magnets. FIG. 2 shows the bobbin illustrated only with the wire connection to the terminals without the printed circuit board, pole pieces and magnet.

In FIG. 1, the pickup 10 includes a base 12 and a top or cover 14 connected by a post structure 16. The base 12, the top 14 and the post structure 16 may be an integral molded structure. A support 18 may be provided at both ends between the base 12 and the top 14. Support 18 is for the pressure produced by the fingers of a player, which may rest on the pickup top 14 during playing. Support 18 may be eliminated if not desired.

As illustrated in FIG. 3, an opening 20 is provided in a first face 22 of the base 12. The first face 22 is recessed relative to a second face 24 of the base 12. As illustrated in FIGS. 2 and 3, a plurality (for example, three) of lateral recesses 26 are provided on a first lateral edge 28 of the base 12. A lateral recess 30 (illustrated in FIGS. 1 and 2) is provided on the opposite lateral face 32 of the base 12. Each of the lateral recesses 26 includes a first terminal portion 34 extending into the recess 26 and not extending past the surface 28. A second terminal portion 36 extends from face 22 of the base 12 generally transverse to the first terminal portion 34. Also, extending from the face 22 of the base 12 is a second terminal portion 36 adjacent the edge 32 of the base 12. The same L- or T-type structure for the terminal having first portion 34 and a second portion 36 may be molded into the base 12. In that the first portion 34 does not extend past the lateral edges and there are no recesses 26 on the lateral face 32, there is no accessibility to the first terminal portion 34 at the edge 32.

Figure 5:
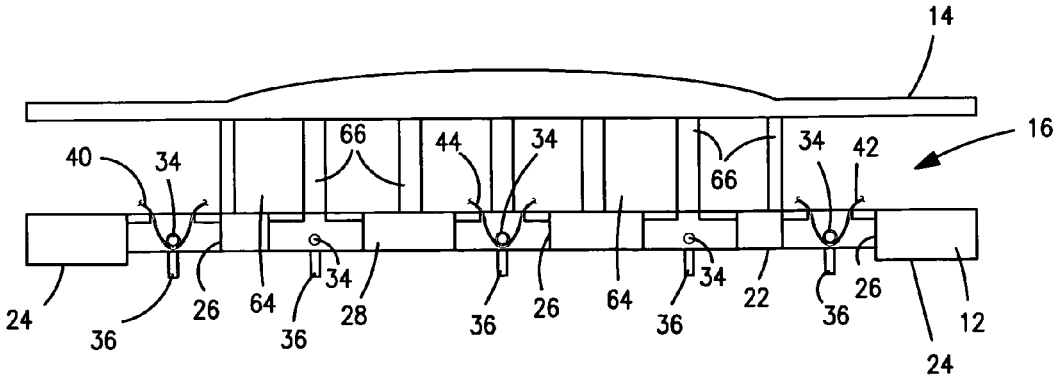
FIG. 5 is a side view of a bobbin with five recesses and terminals.

As illustrated in FIG. 1, windings of coil 38 are wound around the post structure 16 between the base 12 and the tops 14. As illustrated in FIG. 2, the ends 40, 42 of the coil 38 are wrapped around first terminal portions 34 at the two end recesses 26. A portion of wire 44 of the coil 38 intermediate the ends 40, 42 are connected to the first terminal portion 34 in the center recess 26. Although only one intermediate tap is shown in FIGS. 2 and 3, a plurality of recesses 26 may be provided between the two end recesses with multiple taps to the coil 38 intermediate the end wire terminals 40, 42. As illustrated in FIG. 5, there are five recesses 26 with terminals 34, 36.

The post structure 16 includes one or more cavities 46, as shown in FIG. 3. The one or more cavities 46 may include individual pole pieces 48A (as illustrated on the left side of FIG. 1) or a single continuous pole piece 48B (as illustrated on the right side of FIGS. 1 and 3). One or magnets 50A may be provided in the cavity 46 (as illustrated in the left side of FIGS. 1 and 3), or a single magnet 50B may be provided in the lateral recess 30 (as illustrated in the right side FIGS. 1 and 3). In either case, the magnets 50 are immediately adjacent if not touching the pole pieces 48. If the pole pieces 48B extend the total length of the cavity 46 and beyond the recess 30, the magnet 50B will only be in the recess 30 (as illustrated in FIGS. 1 and 3). If the pole pieces 48 in the cavity 46 do not extend beyond the recess 30, the magnet 50B would then extend beyond the recess 30 over the top of the pole pieces 48B. It should also be noted that pole pieces 48A may be a unitary structure, and the magnets 50A may also be a unitary structure instead of individual structures, as illustrated in FIGS. 1 and 3.

A recess 52 is shown in dotted lines in FIG. 1 in the center of the top 14. The pole pieces 48A, 48B extend into the recess 52. This is but a mere example. A cover 14 may be totally flat with the recess 52 being totally flat instead of arced. Also, the recess 52 may be eliminated.

As illustrated in FIGS. 1 and 3, a printed circuit board 54 is provided on face 22 of the base 12 in the recess formed between the second face 24. The second terminal portions 36 extend up through the printed circuit board 54, and the circuit board 54 is secured to the base 12 by soldering 58. The printed circuit board 54 includes a connector 56 connected by conductors 60 to the terminals 36. Connector 56 has a contact for each terminal 36. A plug is provided into connector 56 to connect the pickup to the appropriate circuitry. This may be, for example, a ribbon connector. A shield layer 62, as illustrated in FIG. 1, may be provided across the face of the PC board 54 opposite the connector 56. This will be connected to ground through the connector 56. This provides a shield across the base 12 to shield electromagnetic interference from the pickup coil 38.

In order to increase the magnetic efficiency of the pickup 10, the post structure 16 includes a plurality of windows 64 allowing the windings of the coil 38 to be immediately adjacent the pole pieces 48, as illustrated in FIG. 3. In order to produce these windows 64, the post structure 16 includes a plurality of struts 66. As illustrated in FIG. 3, the struts 66 lie within the area defined by the projection of the opening 20 in the base 12. If individual pole pieces 48A and magnets 50A are provided, the struts 66 may extend across the opening 20 and, therefore, define a plurality of cavities. Alternatively, if a single notched pole piece 48B is used, struts 66 will not go all the way across (as shown) and, therefore, define a single cavity 46. Strut structure 66 minimizes the size of the post structure 16 and increases the size of the window 64, thereby minimizing the separation between the pole pieces 48 and the wires of the coil 38. Other post structures 16 may be used to provide the windows 64.

Figure 4:
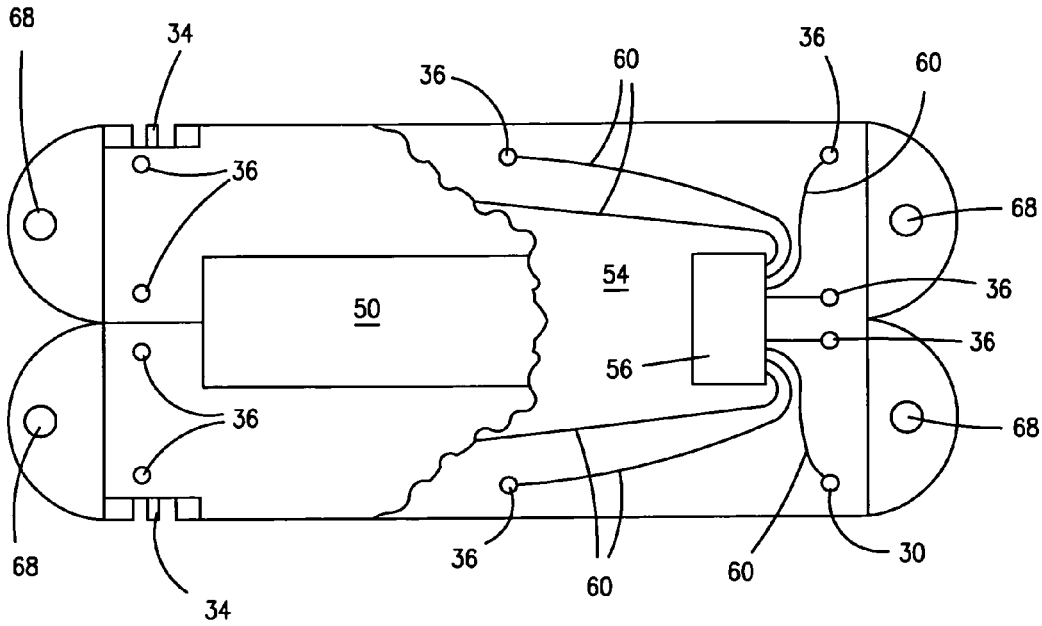
FIG. 4 is a bottom view of a dual coil hum canceling pickup according to the present disclosure.

The ability to use the bobbin and coil of FIGS. 1 through 3 as a double hum canceling coil is illustrated in FIG. 4. A pair of pickups 10 are placed side by side with edge 32 of the base adjacent each other. This allows using a single, common magnet 50B extending across the adjacent lateral recesses 30. This allows a single magnet 50B to polarize the pole pieces 48 in opposite polarity. A single PC board 54 with a single connector 56 is shown. This illustrates the versatility of the pickup 10 and bobbin structure such that it can be used for a single coil, as illustrated in FIGS. 1 through 3, or as a dual hum canceling coil pickup of FIG. 4.

Apertures 68 are provided in the base 12 and the top 14, as well as the support 18, to receive fasteners to mount the pickup 10 in a stringed musical instrument body.

Although the present disclosure has been described and illustrated in detail, it is to be clearly understood that this is done by way of illustration and example only and is not to be taken by way of limitation. The scope of the present disclosure is to be limited only by the terms of the appended claims.

What is claimed:

1. A bobbin for a pickup for a stringed musical instrument, the bobbin comprising:

a base and a top spaced and connected by a post structure integral thereto;

the post structure having one or more cavities for receiving one or more pole pieces;

the post structure including a plurality of lateral windows so that the one or more pole pieces in the one or more cavities would be immediately adjacent windings of one or more coils to be wound on the bobbin.

2. The bobbin of claim 1, wherein the post structure is a plurality of struts spaced about the periphery of the one or more cavities to form the lateral windows there between.

3. The bobbin of claim 2, wherein the base includes an opening to the one or more cavities, and the struts are interior a projected volume defined by the base opening.

4. The bobbin of claim 1, wherein the base, top and post structure are a single molded piece.

5. The bobbin of claim 1, wherein the base includes at least two recesses on a first lateral edge and a terminal in the base for each recess, each terminal having a first portion extending into the recess and a second portion extending from a first outer surface of the base transverse to the first portion.

6. The bobbin of claim 5, wherein the first outer surface of the base is recessed relative to a second outer surface, and the recess in the second surface is for receiving a plate to be secured to the bobbin by the second portions of the terminals.

7. The bobbin of claim 5, including a third recess on a lateral edge of the base opposite the first lateral edge and extending substantially a length of the one or more cavities, and the third recess is for receiving a magnet for the pole pieces.

8. A pickup including a bobbin of claim 5; and wire wound around the post structure and having ends connected to respective first portions of the terminals.

9. The bobbin of claim 1, including a recess on a lateral edge of the base and extending substantially a length of the one or more cavities, and the recess is for receiving a magnet for the pole pieces.

10. The bobbin of claim 9, wherein the base includes one or more openings to the one or more cavities, and the recess extends to the one or more openings.

11. A pickup including a bobbin of claim 10; one or more pole pieces in the one or more cavities; wire wound around the post structure and immediately adjacent the pole pieces; and a magnet in the recess immediately adjacent the one or more pole pieces.

12. A pickup including a bobbin of claim 1; one or more pole pieces in the one or more cavities; and wire wound around the post structure and immediately adjacent the pole pieces.

13. The pickup of claim 12, including a pole piece and a magnet in each cavity.

14. A bobbin for a pickup for a stringed musical instrument, the bobbin comprising:

a base and a top spaced and connected by a post structure;

the post structure having one or more cavities for receiving one or more pole pieces;

at least two recesses on a first lateral edge of the base;

a terminal in the base for each recess, each terminal having a first portion extending into the recess and a second portion extending from a first outer surface of the base transverse to the first portion;

the first outer surface of the base being recessed relative to a second outer surface; and the recess in the second surface being for receiving a plate to be secured to the bobbin by the second portions of the terminals.

15. A pickup including a bobbin of claim 14, wire wound around the post structure and having ends connected to respective first portions of the terminals; and a plate in the second surface recess and being a printed circuit board with an electrical connector electrically connected to the second portions of the terminals.

16. A bobbin for a pickup for a stringed musical instrument, the bobbin comprising:

a base and a top spaced and connected by a post structure;

the post structure having one or more cavities for receiving one or more pole pieces;

at least two recesses on a first lateral edge of the base;

a terminal in the base for each recess, each terminal having a first portion extending into the recess and a second portion extending from a first outer surface of the base transverse to the first portion;

wire wound around the post structure and having ends connected to respective first portions of the terminals; and a printed circuit board secured to the bobbin by the second portions of the terminals and having an electrical connector electrically connected to the second portions of the terminals.

17. The bobbin of claim 14, wherein the base includes at least three recesses on the first lateral edge, each with a terminal.

18. The bobbin of claim 14, including a third recess on a lateral edge of the base opposite the first lateral edge and extending substantially a length of the one or more cavities, and the third recess is for receiving a magnet for the one or more pole pieces.

19. The bobbin of claim 18, wherein the base includes one or more openings to the one or more cavities, and the third recess extends to the one or more openings.

20. A pickup including a bobbin of claim 19; one or more pole pieces in the one or more cavities; wire wound around the post structure; and a magnet in the third recess immediately adjacent the one or more pole pieces.

21. A pickup including a bobbin of claim 14; and wire wound around the post structure and having ends connected to respective first portions of the terminals.

22. A bobbin for a pickup for a stringed musical instrument, the bobbin comprising:

a base and a top spaced and connected by a post structure;

the post structure having one or more cavities;

a pole piece and a magnet in each cavity;

at least two recesses on a first lateral edge of the base;

a terminal in the base for each recess, each terminal having a first portion extending into the recess and a second portion extending from a first outer surface of the base transverse to the first portion.

23. A bobbin for a pickup for a stringed musical instrument, the bobbin comprising:

a base and a top spaced and connected by a post structure;

the post structure having one or more cavities for receiving one or more pole pieces;

at least two recesses on a first lateral edge of the base;

a terminal in the base for each recess; and a third recess on a lateral edge of the base opposite the first lateral edge and extending substantially a length of the one or more cavities, the third recess is for receiving a magnet for the one or more pole pieces.

24. The bobbin of claim 23, wherein the base includes one or more openings to the one or more cavities, and the third recess extends to the one or more openings.

25. A pickup including a bobbin of claim 24; one or more pole pieces in the one or more cavities; wire wound around the post structure and having ends connected to respective terminals; and a magnet in the third recess immediately adjacent the one or more pole pieces.

26. A pickup including a bobbin of claim 23; one or more pole pieces in the one or more cavities; wire wound around the post structure and having ends connected to respective terminals; a magnet in the third recess; and a printed circuit board secured to the bobbin by the terminals and having an electrical connector electrically connected to the terminals.

27. The pickup of claim 26, wherein the printed circuit board covers the pole pieces and the magnet.

28. A pickup including a pair of bobbins of claim 23; each bobbin including one or more pole pieces in the one or more cavities and wire wound around the post structure and having ends connected to respective terminals; a common magnet in lateral adjacent third recesses; and a printed circuit board secured to the bobbins by the terminals and having an electrical connector electrically connected to the terminals.

29. The pickup of claim 28, wherein the printed circuit board covers the pole pieces and the magnet.

30. The pickup of claim 28, wherein the bobbins each include a recess in a first face of the base, and the printed circuit board lies in the face recesses.

31. A pickup for a stringed musical instrument, the pickup comprising:

a bobbin having a base and a top spaced and connected by a post structure;

at least one pole piece in at least one cavity in the post structure;

at least two terminals in the base and having a first portion extending from a face of the base;

a coil having a wire wound around the post structure and having ends connected to respective terminals;

a magnet in the bobbin adjacent the at least one pole piece; and a printed circuit board secured to the base by the terminals and having an electrical connector electrically connected to the terminals.

32. The pickup of claim 31, wherein the printed circuit board covers the at least one pole piece and the magnet.

33. The pickup of claim 31, wherein the base each includes a recess in the first face of and the printed circuit board lies in the face recesses.

34. A dual pickup for a stringed musical instrument, the pickup comprising:

two bobbins each having a base and a top spaced and connected by a post structure, at least one pole piece in at least one cavity in the post structure, at least two terminals in the base and having a first portion extending from a first face of the base, a coil having a wire wound around the post structure and having ends connected to respective terminals, and a magnet in the bobbin adjacent the at least one pole piece; and a printed circuit board secured to the bases by the terminals and having an electrical connector electrically connected to the terminals.

35. The pickup of claim 34, wherein the printed circuit board covers the pole pieces and the magnets.

36. The pickup of claim 34, wherein the base each includes a recess in the first face, and the printed circuit board lies in the face recesses.

37. The pickup of claim 34, including at least three terminals, and the wire has its ends connected to two of the terminals a portion between the end to a third terminal.

38. The pickup of claim 34, wherein the magnet in each bobbin is a single common magnet bridging the bases and polarizing the pole pieces of opposite polarity.

39. The pickup of claim 34, wherein the connector has a separate pin for each terminal.

40. The pickup of claim 34, wherein the printed circuit board includes a shield layer on a face opposite a face on which the connector is mounted, and the shield layer is electrical connected to the connector.

* * * * *